United States Patent [19]

Tichy

[11] 4,386,889

[45] Jun. 7, 1983

[54] RADIAL WAVE PUMP

[76] Inventor: James B. Tichy, P.O. Box 746 Waldo Point, Sausalito, Calif. 94965

[21] Appl. No.: 293,552

[22] Filed: Aug. 17, 1981

[51] Int. Cl.[3] ..... F04B 19/00

[52] U.S. Cl. ..... 417/487; 92/107

[58] Field of Search ..... 417/469, 474, 486, 487, 417/489, 215, 510; 92/107, 108, 53, 72, 6 R, 60

[56] References Cited

U.S. PATENT DOCUMENTS

| | | | |
|---|---|---|---|
| 1,795,236 | 3/1931 | Schupp | 417/469 |
| 1,922,196 | 8/1933 | Butler | 417/474 X |
| 2,703,191 | 3/1955 | Jernander | 417/487 X |
| 3,266,433 | 8/1966 | Mason | 417/469 X |
| 3,775,027 | 11/1973 | Craft | 417/487 X |

FOREIGN PATENT DOCUMENTS

| | | | |
|---|---|---|---|
| 209497 | 11/1956 | Australia | 92/53 |

*Primary Examiner*—Leonard E. Smith

*Attorney, Agent, or Firm*—Townsend and Townsend

[57] ABSTRACT

A positive displacement pump comprising an enclosure having parallel walls and a plurality of concentric annular rings reciprocally mounted between said walls is disclosed. By reciprocating the rings in a predetermined sequence, fluid is caused to flow through a series of radially propagating chambers defined by the rings.

11 Claims, 8 Drawing Figures

RADIAL WAVE PUMP

BACKGROUND OF THE INVENTION

1. Field of the Invention

The present invention relates generally to pumps and, more particularly, to a positive displacement pump which impels fluid through a series of annular chambers defined by multiple reciprocating annular rings.

2. Description of the Prior Art

It is known to pump fluid through a deformable member, such as a resilient tube, by compressing the tube to seal the flow path at a point and moving the point of compression axially along the tube to force fluid therethrough. While such tube pumps are valuable for metering precise amounts of fluid and for handling abrasive, toxic and other hard-to-handle fluids, such pumps are limited in that they can handle only a very low volumetric throughput at moderate temperatures and low pressures.

A particular problem has been encountered in pumping large volumes of fluids while minimizing suction vaporization defines the intake reliability of a pumping system. Sludge with entrapped air, hot or volatile fluids in a high speed system are prone to cavitate with attendant performance degradation. Conversely, a smaller mechanical system of equivalent fluid performance permits a greater strength to weight ratio. Thus, a positive, high capacity unit with a low net positive suction head requirement which can operate in a broad range of speeds and viscosities is desirable.

SUMMARY OF THE INVENTION

The present invention provides a positive displacement pump capable of metering an accurate amount of fluid at a relatively high volumetric flow rate. The pump comprises a plurality of concentric annular rings arranged to reciprocate in the direction of the concentric axis in an enclosure including at least one end plate. In the preferred embodiment, a pair of parallel end plates are sealed by a wall which is spaced apart from the outermost annular ring to form an outer plenum. At least one port through the wall provides for fluid communication between the outer plenum and the exterior of the pump. An inner plenum is defined generally by the interior cylindrical wall of the innermost ring and the opposed faces of the parallel plates. One or more additional ports are provided at or near the center of one or both the parallel end plates (in communication with the inner plenum) and fluid flows between said first ports and said additional ports, in either direction, depending on the sequence in which the annular rings are reciprocated.

Assuming that the fluid is to be pumped from the outer plenum to the inner plenum, the pumping sequence begins with the outer ring moving away from the end plate, leaving an open volume into which fluid in the outer plenum is allowed to flow. As the outer ring approaches the full extent of its travel away from the end plate, the middle ring begins to move away from the end plate, opening a new volume so that the fluid flowing into the volume overlying the outer ring continues to flow inwardly into the volume overlying the middle ring. In the meantime, the outer ring is moving back toward the end plate to provide a seal so that the water overlying the middle ring cannot flow radially outwardly, and as the middle ring approaches the full extent of its travel the inner ring begins to move away from the end plate, allowing the fluid to continue to flow inwardly into the inner plenum and then out through the outlet. Pumping action from the inner plenum to the outer plenum can be accomplished by simply reversing the sequence.

In the preferred embodiment, three rings are provided with the center ring having twice the annular area of the outer and inner rings to assure the smooth flow of fluid through the pump. The rings are reciprocated 120° out of phase with the outermost ring leading the middle and innermost ring by 120° and 240°, respectively. By driving the rings in that sequence, fluid flows from the outer plenum to the inner plenum. By reversing the drive so that the outer adjacent rings lag, fluid will flow from the inner plenum to the outer plenum.

An advantage of the pump is a very low inlet pressure requirement when compared to conventional positive displacement pumps. To operate at full capacity requires only sufficient pressure to assure that volume beneath the initial annular ring be filled with fluid as the ring moves away from the opposed parallel plate. Since the inlet port to either the inner or outer chamber can be made virtually as large as the chamber, there will be very little pressure drop to impede the operation. Thus the present pump will be useful in pumping viscous and volatile fluids in high capacity applications with a low net positive suction head requirement. It should be noted that if the differential pressure between the inlet and output becomes great enough to overcome the drive-shaft torque the pump will motor.

The novel features which are characteristic of the invention as to organization and method of operation together with further objects and advantages thereof will be better understood from the following description considered in connection with the accompanying drawings, in which a preferred embodiment of the invention is illustrated by way of example. It is to be expressly understood, however, that the description and the drawings are for the purposes of illustration only and are not intended as a definition of the limits of the invention.

DESCRIPTION OF THE PREFERRED EMBODIMENT

Figure 1:
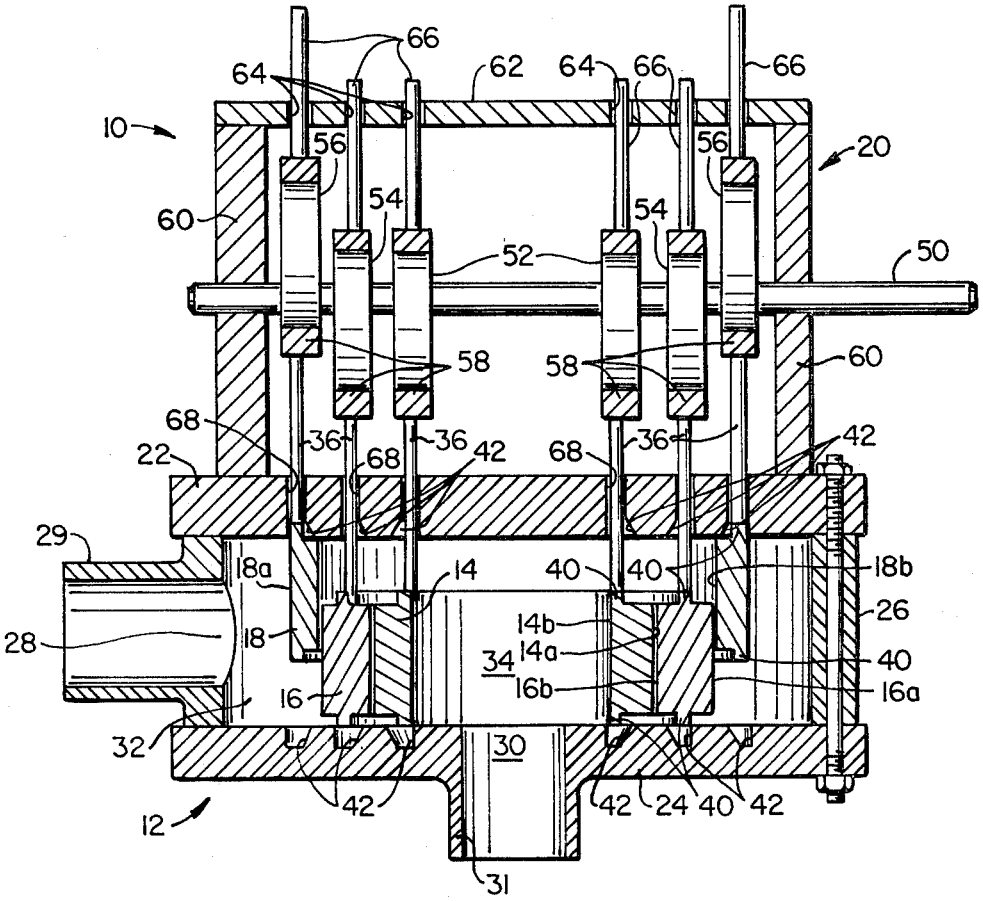
FIG. 1 is a cross-sectional elevational view of the preferred embodiment of the pump of the present invention.

Referring to FIG. 1, a pump 10 comprising an enclosure 12, three annular rings 14, 16, 18, and a drive assembly 20 for reciprocating the rings within the enclosure are illustrated. The enclosure 12 comprises first and second parallel end plates 22, 24 and a cylindrical wall 26 extending between the parallel plates to form a generally fluid-tight chamber. A first port 28 is provided through the cylinder 26 and will typically include a boss 29 or the like for forming a process connection. The first port 28 communicates with an outer plenum 32 defined by the outer cylindrical surface 18*a* of ring 18, the interior surface of cylindrical wall 26, and the parallel plates 22, 24. A second port 30 is provided through the second parallel plate 24 (generally at the center thereof) and communicates with an inner plenum 34 defined generally by the inner cylindrical surface 14*b* of ring 14. The second port 30 also includes a boss 31 or the like for making a process connection and fluid flow through the pump 10 can be either from the first port 28 to the second port 30, or in the opposite direction, depending on the manner in which the pump is operated, as described more fully hereinafter.

Each of the annular rings 14, 16, 18 is mounted on a pair of connecting rods 36 which form a part of the drive assembly 20, as described more fully hereinafter. The rings 14, 16, 18 are arranged so that their radial planes lie substantially parallel to the planes of the parallel plates 22, 24. The rings 14, 16, 18 are arranged coaxially and are free to reciprocate along their common axis which is perpendicular to said planes. Adjacent cylindrical faces (i.e., 14*a*, 16*b* and 16*a*, 18*b*) of the rings are sufficiently close to form a substantially fluid-tight seal between the rings. Alternatively, the rings 14, 16, 18 may be provided with "rings" (not shown) similar to those found on piston engines and other reciprocating equipment to prevent leakage.

The pumping action is achieved by formation of a radially propagated annular cavity defined by the relative motions of the annular rings 14, 16, 18. In the particular embodiment, such cavities will be formed both above and below the annular rings 14, 16, 18, and each will contribute to the total throughput of the pump 10, as described in detail in connection with FIGS. 4 and 5A–5D, hereinbelow. The following description relates to the flow between the rings and the second plate 24, but applies equally to the flow adjacent the first plate 22.

For proper operation, it is necessary that the sum of the radial areas of rings 14 and 18 be equal to the radial area of ring 16 so that the volume of the entire displacement bounded by the radial areas of rings 14, 16 and 18 and the end plate 24 be constant throughout the entire cycle. In embodiments having more than three rings the radial areas of the inner ring and outer ring shall each be one half the radial area of each one of the enclosed rings.

For proper operation it is also necessary that the radial face of each of the rings 14, 16, 18 form a seal with the adjacent parallel plate 22 or 24 during a portion of the pump cycle. The seal is formed by an annular locking ridge 40 projecting outward from both radial faces of each ring 14, 16, 18 and associated channels 42 formed in both of the parallel plates 22, 24. The height of the locking ridge determines the duration of the seal. A longer seal time, and thus a higher locking ridge 40, is necessary as the number of rings in the pump is reduced, as will be described more fully hereinafter.

Figure 2:
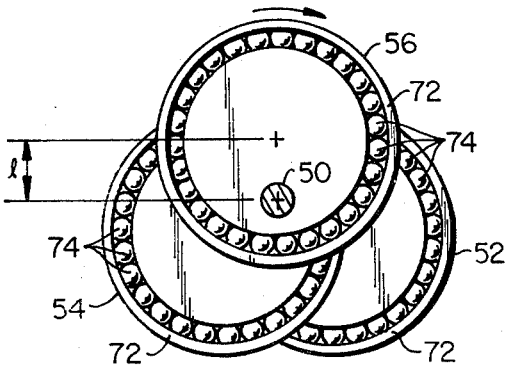
FIG. 2 is an end view of the eccentric cam shaft utilized in the embodiment of FIG. 1.
Figure 3:
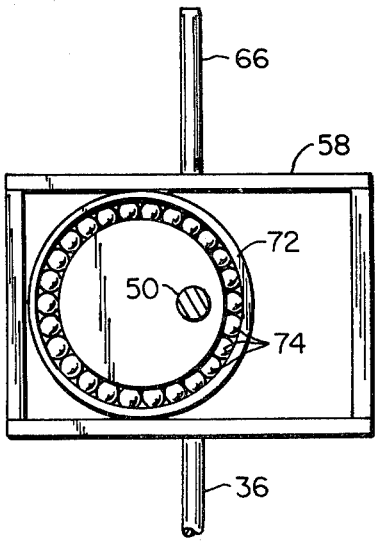
FIG. 3 is an end view of a single eccentric cam of the first embodiment mounted on a driving rod.

The drive assembly 20 reciprocates the connecting rods 36 in a predetermined phase relationship for operating the pump 10. The assembly 20 can take any form which meets this objective, for example, various types of solenoids would be adequate. The preferred embodiment employs an eccentric cam shaft 50 having three pairs of eccentric cams 52, 54, 56 mounted thereon. Referring to FIGS. 1, 2 and 3, the eccentric cams are arranged on the shaft rotationally spaced-apart by 120°. The cam length l (FIG. 2) is the distance between the center of the cam and the center of the cam shaft 50 and is equal for each of the six cams 52, 54, 56. Each cam is mounted in a cage 58 (FIG. 3) which is directly connected to the connecting rod 36. The shaft 50, in turn, is mounted in a pair of support brackets 60 (FIG. 1) extending upward from the exterior surface of the first parallel plate 22. The brackets are joined by a top plate 62 extending therebetween and secured thereto, said plate having six holes 64 adapted to receive an extension rod 66 projecting upward from the cage 58. The first parallel plate 22 includes six holes 68 which are generally aligned with the six holes in the top plate. The cages 58 are mounted so that the extension rod 66 projects through the hole 64 in the top plate and the connecting rod 36 projects through the corresponding hole 68 in the first parallel plate 22. Thus, by rotating the cam shaft 50, the connecting rods 36 may be reciprocated 120° out of phase with a total displacement of twice the cam length 2 l.

The cams 52, 54, 56 will typically include a bearing ring 72 supported on the central portion of the cam by a plurality of ball bearings 74. Adequate lubrication is provided so that the cam may move within cage 58 freely as the shaft 50 is rotated.

Referring now to FIGS. 4 and 5A–5D, the operation of a pump having three rings will be explained in detail. The operation of a pump having a greater number of rings will be analogous although certain of the parameters, including the height of the locking ridge 40 and the phase relationship of the various rings, will vary. In general, for a pump having n number of rings, the rings will be driven out of phase by 360/n degrees. The operation of the pump 10 will be described for fluid flow from the first port 28 to the second port 30. Such flow corresponds to rotation of the cam shaft 50 in the clockwise direction (as shown by the arrow in FIG. 2).

Figure 4:
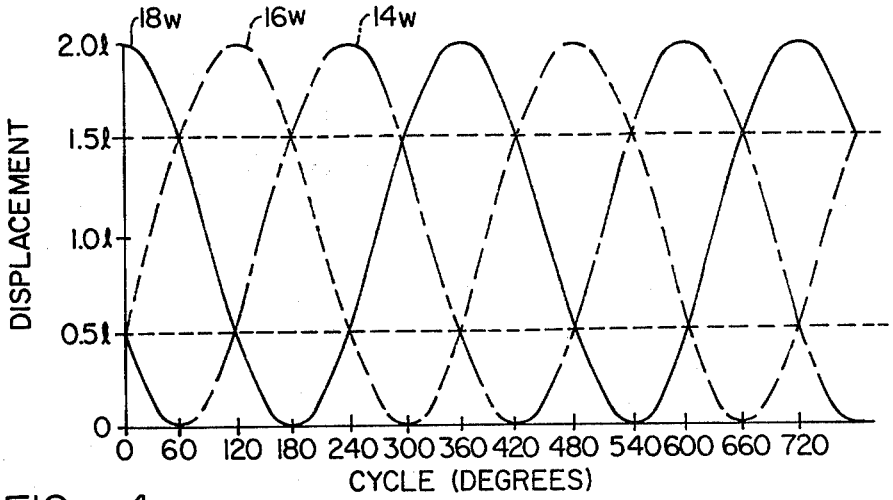
FIG. 4 is a graph illustrating the position of each annular ring as a function of cycle time.
Figure 5A:
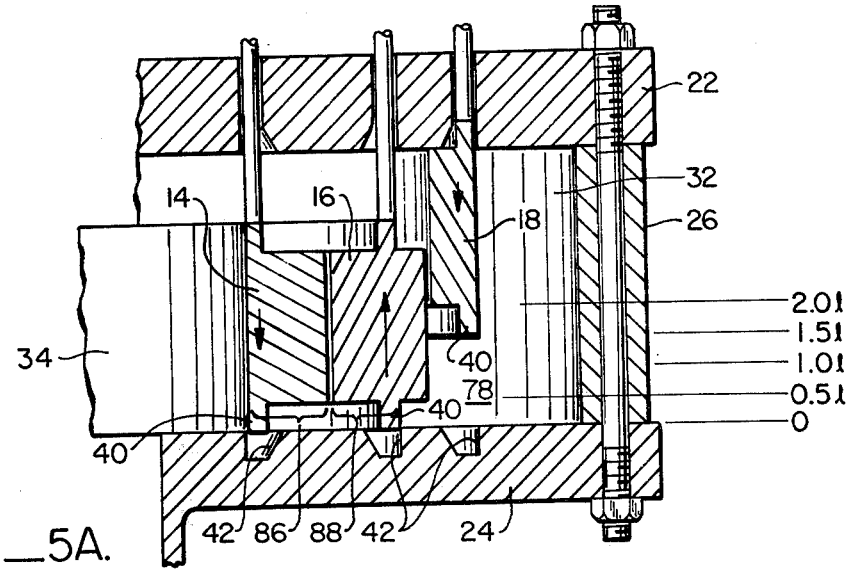
FIGS. 5A–5D illustrate the relative movement of the annular rings during one-half cycle of operation.

FIG. 4 illustrates the displacement of each of the annular rings 52, 54, 56 as a function of the pump cycle shown as the degree of rotation of shaft 50 where the position of the shaft shown in FIG. 2 has been arbitrarily chosen as 0°. This position (0°) corresponds to the locations of the annular rings as shown in FIG. 5A. The displacement is shown in multiples of cam length l measured from the interior surface of plate 24 to the opposed radial face of the particular ring. A scale indicating the length of displacement is included on each of FIGS. 5A–5D for cross-reference.

FIG. 4 includes three sine waves 14*w*, 16*w*, 18*w* corresponding to the positions of the rings 14, 16, 18, respectively. At 0°, ring 18 is in its fully raised position corresponding to a height 2 l above the second plate 24. At the same time, both rings 14 and 16 are raised a height 0.5 l above the plate 24 with ring 14 descending and ring 16 ascending, as indicated by the arrows in FIG. 5A. (The length of the arrows indicating generally the magnitude of the distance to be covered over the next 60° of pump cycle.) At this point, an annular cavity, shown generally at 78, is defined beneath (as viewed in FIGS. 5A–5D) the lower cylindrical surface of ring 18. The cavity 78 has a volume generally equal to the radial area of the ring 18 multiplied by the height 2 l above plate 24.

Figure 5B:
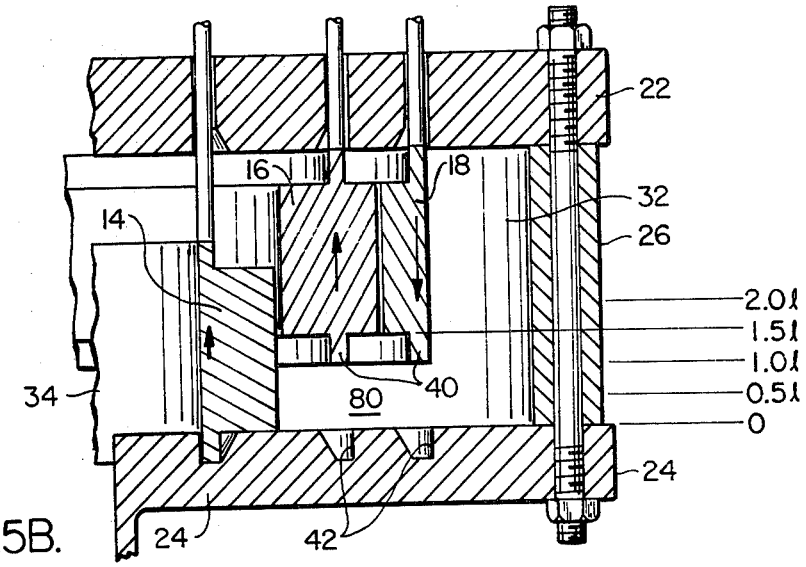

Over the next 60°, ring 18 descends to a height of 1.5 l over plate 24, while ring 16 rises to the same height, as illustrated in FIG. 5B. A slightly larger cavity 80 is formed between the lower radial faces of rings 16, 18 and the plate 24. The fluid entering the pump through inlet port 28 and outer plenum 32 will flow into this cavity 80 under a minimal inlet pressure.

Figure 5C:
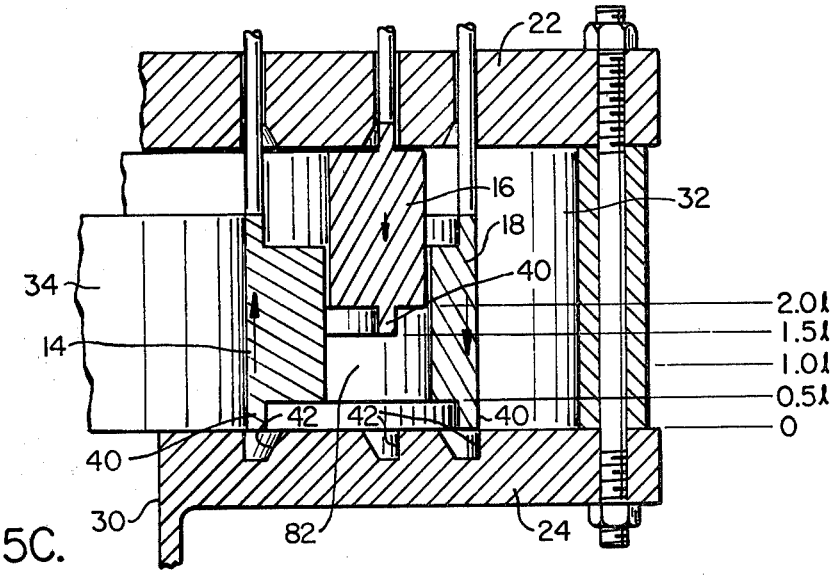

As the pump cycle continues, the outermost annular ring 18 continues downward until reaching a height 0.5 l at 120° as shown in FIG. 5C. At this point the locking ridge 40 on ring 18 engages the associated channel 42 formed in plate 24 to seal the fluid beneath ring 16 from the outer plenum 32. The locking ridge 40 on the innermost ring 14 continues to engage its associated channel 42 and for a brief instant of time the quantity of fluid is trapped in a cavity 82 formed by all three of the rings and the interior surface of plate 24. At this point also, the central ring 16 is in its most raised position, and the volume formed beneath ring 16 is generally equal to the radial surface area of the ring times the height, 2 l.

Figure 5D:
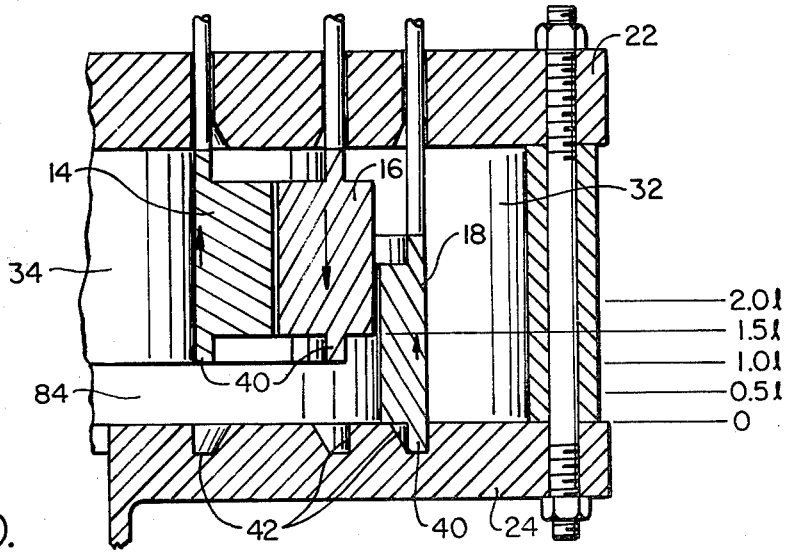

As the pump cycle continues, outermost ring 18 continues downward with the seal formed between locking ridge 40 and channel 42 remaining intact. Ring 16 begins its downward stroke, which impels the fluid beneath it to flow inward toward a cavity 84 of increasing volume being formed beneath ring 14 which is moving upwardly, as illustrated in FIG. 5D. During the remainder of the cycle, ring 16 will continue downward until sealing against plate 24 while ring 14, which lags ring 16 by 120°, continues its upward stroke and returns downward, sealing with plate 24 before the seal with ring 16 has been broken. In this way, the fluid is positively displaced into the inner plenum 34.

The height of the locking ridge 40 is an important parameter since it determines the portion of the cycle during which the associated ring is sealed against the plates 22, 24. For the three-ring embodiment described herein, the height must be a minimum of one-half the cam length (0.5 l) shown in FIG. 2. With this height, each ring is sealed against each of the parallel plates 22, 24 during one third (or 120°) of the pump cycle. This can be seen best in reference to FIG. 4, where the ring displacement (measured from the radial face of the ring) is less than 0.5 l during one third of each 360° cycle and greater than 1.5 l during a separate one-third of the cycle. This is necessary for two reasons. First, one of the rings 14, 16 or 18 is sealed against each of the plates 22 and 24 at all times to prevent back flow through the pump. Second, a seal such as 40 on ring 18, as shown in FIG. 5C, must be maintained behind the sum of the volume displacements of each of the rings 14, 16 and 18 and end plate 24 so that the fluid flows in the desired (inward) direction. This is understood best in reference to FIGS. 5C and 5D where ring 18 seals against plate 24 just at the moment ring 16 is in its uppermost extension. Thus, as ring 16 descends, and the seal on ring 14 is broken, the fluid must flow inward to the expanding cavity beneath ring 14. Meanwhile, ring 18 remains sealed until the point when the lock ridge 40 of ring 16 reaches sealing engagement with plate 24 at 240° in the pump cycle. At that point, ring 18 ascends to take on an additional charge of fluid to being impelled through the pump 10.

For pumps having more than three rings, the height of the locking ridge will be less. The height (h) may be found using the following formula:

$$h = l(1 - \cos(180°/n))$$

where l = cam length n = number of rings

A second parameter of interest is the radial width of the annular rings 14, 16, 18. As mentioned hereinabove, the radial surface area of the center ring 16 must be twice that of the radial surface area of either ring 14 or ring 18. This ratio comes about from the pecularity in which the three rings simultaneously contribute to the volume displacement. Referring to FIG. 5C and in particular to cavity 88, the sum of the decreasing volume displacements of rings 16 and 18 above end plate 24 is greater than the increasing volume displacement of ring 14 above end plate 24 resulting in a net output volume decrease. The resulting net volume displacement (q) for a 60 degree advance of the cycle may be found using the formula $$a = A\ l/2$$

where A = radial area of inner ring 14

Each 60 degree advance of the cycle displaces an equal amount of fluid toward the output. The radial area of ring 14 can vary with a larger area corresponding to a greater volumetric throughput per pump cycle. Once the area (i.e., throughput) has been selected, the radial width of the innermost ring 14 can be calculated based upon a value for the inner diameter of the innermost ring, typically chosen to correspond to the diamter of the port 30. The dimensions of the remaining rings 16, 18 can be calculated according to well-known geometric principles.

The axial width of the annular rings 14, 16, 18 is less critical. It is necessary only that adjacent rings overlap at all times during the pump cycle to prevent leakage therebetween. Thus, an axial width greater than 2 l sin (180°/n) is necessary. Sufficient overlap should be provided so that adjacent rings will seal. The distance between the parallel walls 22, 24 will equal the width of the rings plus the distance 2 l.

A final parameter of interest is the radial location of the locking ridges 40 on the annular rings 14, 16, 18. It is desirable that the flat radial surface areas on adjacent annular rings bounded by the locking ridges 40 be maintained equal. Referring to FIG. 5A, radial face 86 defined between locking ridge 40 on ring 14 and the outer cylindrical face thereof should be equal to radial face 88 on ring 16. In this way, during the instant when a small pocket of fluid is trapped between the locking ridges (as shown in FIG. 5A), such fluid will not experience undesirable compression or expansion since the incremental change in volume (dV/dt) at that moment is zero. While this feature is desirable when handling sensitive fluids, it is not necessary for the operation of the pump and the pump would function equally well if the locking ridges were placed elsewhere on the radial faces of the rings, such as at the outermost diameter thereof.

The foregoing description of operation has been made in reference to fluid flow between the lower (as viewed in FIGS. 1 and 5A–5D) radial faces of the rings 14, 16, 18 and the plate 24. Fluid will also be caused to flow between the upper radial faces and plate 22 in an identical manner. No additional description is necessary.

Although the best mode contemplated for carrying out the present invention has been herein shown and described, it will be appreciated that variations and modifications may be made without departing from what is regarded to be the subject matter of the present invention.

What is claimed is:

1. A radial wave pump comprising:

an enclosure having parallel walls;

at least three rings, each ring having two radial faces, an inner cylindrical wall and an outer cylindrical wall, said rings being reciprocably mounted within the enclosure and the inner cylindrical wall of the innermost ring defining an inner chamber and the outer cylindrical wall of the outermost ring defining an outer chamber;

means for reciprocating the rings in an equally spaced-apart phase relationship, adjacent rings having inner and outer cylindrical walls closely spaced to one another so that fluid is substantially prevented from passing therebetween; and means secured to both radial faces of each ring for substantially preventing the flow of fluid between the radial face and the opposed wall during a portion of the reciprocation cycle.

2. A pump for fluids comprising:

at least three annular rings disposed concentrically about a common axis;

an enclosure including at least one end plate and having a port communicating with the interior of the innermost ring; and means for reciprocating said rings in a repetitive sequence so that the rings each engage the plate during a portion of their respective cycles and in combination with the plate define a volume which moves inwardly or outwardly to transfer the fluid between the enclosure outside the outermost ring and the interior of the innermost ring to provide a pumping action.

3. A pump as in claim 2, wherein adjacent rings form a sliding seal therebetween.

4. A pump as in claim 2, wherein each annular ring includes a locking ridge and the end plate has channels disposed to receive the locking ridges during a predetermined portion of the pump cycle.

5. A pump as in claim 2, wherein the number of annular rings is n and the means for mounting and reciprocating drives the rings out of phase by 360/n degrees.

6. A pump for fluids, said pump comprising:

an enclosure including two spaced-apart parallel plates, at least one of said plates having a first port therethrough, and an outer wall extending between said parallel plates and having a second port therethrough;

at least three concentric annular rings mounted within said chamber to reciprocate between said parallel plates, each of said rings including means to seal against the parallel plates as that ring approaches within a predetermined distance of the plate, adjacent of said rings forming a seal therebetween to prevent the flow of fluid;

and means to reciprocate the annular rings in a predetermined phased relationship.

7. A pump as in claim 6, wherein the means for reciprocating the annular rings includes an eccentric cam shaft, connecting rods between the cam shaft and the rings, and a means for rotating the cam shaft.

8. A pump as in claim 6, wherein the pump includes three annular rings and the means for reciprocating drives said three rings 120 degrees out of phase.

9. A pump as in claim 6, wherein the outer and inner annular rings each have a radial surface area equal to one half of each annular ring surface area of each annular ring contained therebetween.

10. A pump as in claim 6, wherein the means for sealing against the parallel plates is a locking ridge formed on the radial face of the annular ring and a channel formed in the parallel plate, said ridge and said channel arranged to mesh as the ring approaches the plate.

11. A pump as in claim 10, wherein the locking ridges on adjacent rings are radially located so that adjacent radial surface areas defined by said locking ridges on adjacent rings are equal.

* * * * *